US011840079B2

(12) United States Patent
Kuriyama et al.

(10) Patent No.: US 11,840,079 B2
(45) Date of Patent: Dec. 12, 2023

(54) INKJET PRINTING APPARATUS AND CONTROL METHOD THEREOF

(71) Applicant: CANON KABUSHIKI KAISHA, Tokyo (JP)

(72) Inventors: Keiji Kuriyama, Saitama (JP); Satoshi Wada, Tokyo (JP); Hidehiko Kanda, Kanagawa (JP); Yoshinori Nakajima, Kanagawa (JP); Takeshi Yazawa, Kanagawa (JP); Hajime Nagai, Kanagawa (JP); Shingo Nishioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 17/367,776

(22) Filed: Jul. 6, 2021

(65) Prior Publication Data

US 2022/0001666 A1 Jan. 6, 2022

(30) Foreign Application Priority Data

Jul. 6, 2020 (JP) ..... 2020-116644

(51) Int. Cl.
*B41J 2/045* (2006.01)

(52) U.S. Cl.
CPC ..... *B41J 2/04573* (2013.01); *B41J 2/04503* (2013.01); *B41J 2/04556* (2013.01); *B41J 2/04586* (2013.01)

(58) Field of Classification Search
CPC ..... B41J 2/04573; B41J 2/04503; B41J 2/04556; B41J 2/04586
See application file for complete search history.

(56) References Cited

U.S. PATENT DOCUMENTS

| | | | | |
|---|---|---|---|---|
| 6,471,315 | B1 | 10/2002 | Kurata | |
| 7,237,858 | B2 | 7/2007 | Igarashi | |
| 7,533,962 | B2 | 5/2009 | Masuyama et al. | |
| 7,651,194 | B2 | 1/2010 | Yazawa et al. | |
| 9,162,441 | B1 * | 10/2015 | Noda | B41J 2/2132 |
| 2015/0273823 | A1 * | 10/2015 | Kato | B41J 2/04556 347/9 |

FOREIGN PATENT DOCUMENTS

| | | |
|---|---|---|
| JP | 11-240146 A | 9/1999 |
| JP | 2006-015542 A | 1/2006 |

* cited by examiner

*Primary Examiner* — Thinh H Nguyen
(74) *Attorney, Agent, or Firm* — Venable LLP

(57) ABSTRACT

An inkjet printing apparatus includes a printhead in which a plurality of ejection ports that eject ink are formed, a carriage mounted with the printhead and reciprocated in a predetermined direction, a conveyance unit to convey a print medium, a platen to support, at a printing position, the conveyed print medium, and an obtaining unit to obtain information regarding a distance from an ejection port surface of the printhead to the print medium at positions in the predetermined direction. The apparatus controls an ink ejection timing in accordance with the information regarding the obtained distance and information corresponding to the number of passes of printing, which is the number of times of moving the carriage to print the image in a unit area of the print medium.

20 Claims, 13 Drawing Sheets

INKJET PRINTING APPARATUS AND CONTROL METHOD THEREOF

BACKGROUND OF THE INVENTION

Field of the Invention

The present invention relates to an inkjet printing apparatus and a control method thereof, and particularly, an inkjet printing apparatus that performs printing while reciprocally scanning a carriage mounted with a printhead, and a control method thereof.

Description of the Related Art

Conventionally, as a printing apparatus that prints images on a various kinds of print media such as paper, a film, and the like, there is known an inkjet printing apparatus that performs printing by ejecting ink intermittently. While reciprocating a carriage mounted with a printhead that ejects ink, the inkjet printing apparatus ejects ink from the printhead, thereby printing an image on a print medium. Therefore, due to the law of inertia, an ink droplet ejected from the printhead drops on the print medium at a position downstream, in the moving direction, of the position of the ejection port where the ink droplet was ejected. The drop position changes depending on, in addition to the moving speed of the printhead and the ejection speed of the ink droplet, the distance (to be referred to as the paper distance hereinafter) between the ejection port ejecting the ink droplet and the print medium.

Therefore, in order to drop the ink droplet at a target drop position of the print medium, it is necessary to adjust the ejection timing of the ink droplet based on the paper distance. On the other hand, various functions have been required for a platen for holding a print medium, and the platen is provided with a suction mechanism for stable holding of the print medium, and an ejected ink receiving port (to be referred to as a borderless preliminary ejection port hereinafter) used for marginless printing or preliminary ejection performed to stabilize ink ejection during printing.

For example, Japanese Patent Laid-Open No. 11-240146 discloses a technique of correcting the drop position by controlling the ejection timing based on displacement information with respect to the reference position of the paper distance. Further, Japanese Patent Laid-Open No. 2006-15542 discloses a technique of controlling the ejection timing of an ink droplet based on the paper distance detected at the position of each of a plurality of ejection ports provided at different positions in the printhead moving direction. These techniques enable control of the ejection timing in accordance with the paper distance in the printhead moving direction.

However, in a case of a plain paper sheet having low rigidity or the like, in the above-described borderless preliminary ejection port, the paper distance fluctuates in the direction of the ejection port array orthogonal to the printhead moving direction. This leads to a problem that the appropriate ejection timing changes for each ejection port.

For example, in the arrangement in which the borderless preliminary ejection port is formed by a rectangular groove whose long side has a length sufficiently larger than the length of the ejection port array in the direction of the ejection port array of the printhead, the print medium located on or near the groove of the borderless preliminary ejection port is deformed. The recess of the print medium in the moving detection of the printhead is large near the central portion of the ejection port array, and the recess of the print medium in the printhead moving direction is small in the end portion of the ejection port array. As a result, a change in paper distance in the printhead moving direction changes in the direction of the ejection port array, and this leads to different ejection timings.

SUMMARY OF THE INVENTION

An aspect of the present invention is to eliminate the above-mentioned problem with conventional technology.

A feature of the present invention is to provide an inkjet printing apparatus that can print a high-quality image on a print medium, and a control method thereof.

According to a first aspect of the present invention, there is provided an inkjet printing apparatus comprising: a printhead in which a plurality of ejection ports that eject ink are formed; a carriage mounted with the printhead and reciprocated in a predetermined direction; a conveyance unit configured to convey a print medium on which an image is to be printed by an ink droplet ejected from the printhead; a platen extending in the predetermined direction and configured to support, at a printing position by the printhead, the print medium conveyed by the conveyance unit; and an obtaining unit provided in the carriage, and configured to obtain information regarding a distance from an ejection port surface of the printhead to the print medium on the platen at a plurality of positions in the predetermined direction, wherein the apparatus comprises a control unit configured to control an ink ejection timing from the printhead in accordance with the information regarding the distance obtained by the obtaining unit and information corresponding to the number of passes of printing, which is the number of times of moving the carriage to print the image in a unit area of the print medium.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
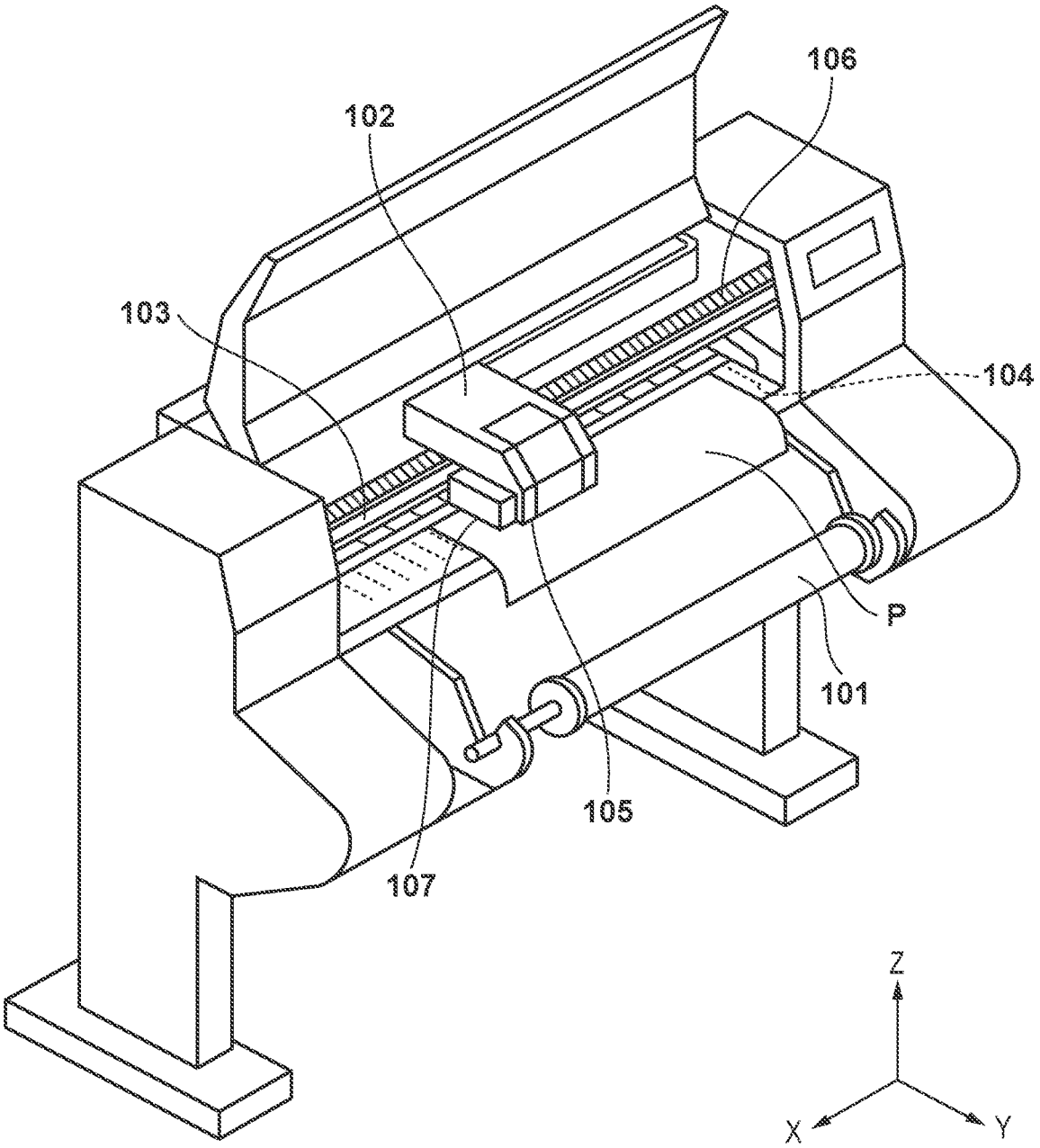
FIG. 1 is an outer perspective view showing the schematic arrangement of an inkjet printing apparatus according to a representative embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

Note that in this specification, the term "printing" (to be also referred to as "print" hereinafter) not only includes the formation of significant information such as characters and graphics, regardless of whether they are significant or insignificant. Furthermore, it broadly includes the formation of images, figures, patterns, and the like on a print medium, or the processing of the medium, regardless of whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted similarly to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "nozzle" generically means an ejection port or a liquid channel communicating with it, and an element for generating energy used to eject ink, unless otherwise specified.

A substrate for a printhead (head substrate) used below means not merely a base made of a silicon semiconductor, but a configuration in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Outline of Printing Apparatus (FIGS. 1 to 4)>

Figure 2:
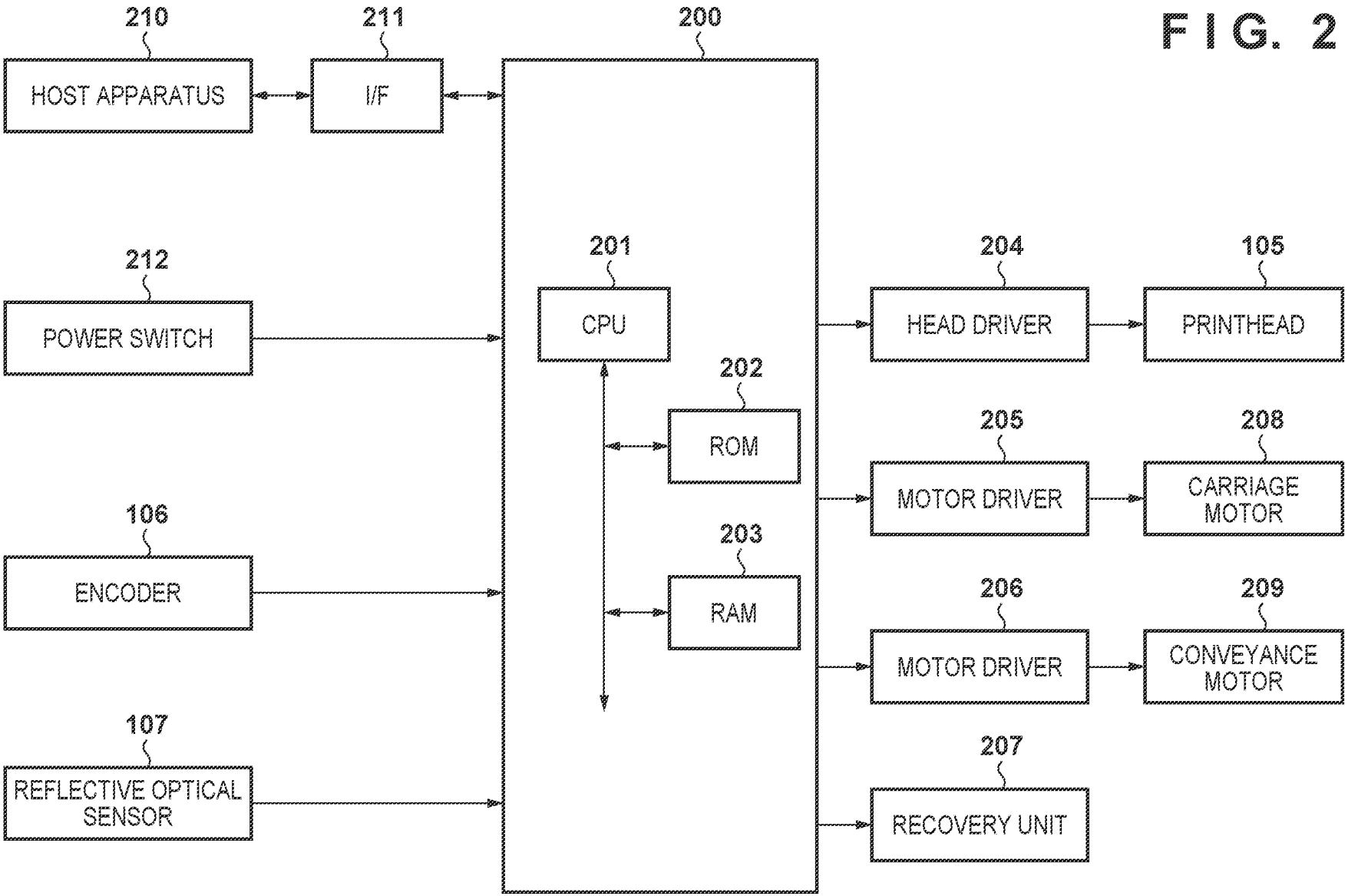
FIG. 2 is a block diagram showing the control configuration of the printing apparatus shown in FIG. 1.

FIG. 1 is a schematic perspective view of an inkjet printing apparatus (to be referred to as a printing apparatus hereinafter) according to a representative embodiment of the present invention. This is a so-called serial scanning printer, which prints an image by scanning a printhead 105 mounted on a carriage 102 in a direction (X direction) orthogonal to the conveyance direction (Y direction) of a print medium P. FIG. 2 is a block diagram showing the control configuration of the printing apparatus shown in FIG. 1.

Here, the outline of the arrangement and a printing operation of the printing apparatus will be described with reference to FIGS. 1 and 2.

First, the print medium P is conveyed from a spool 101 holding the print medium P in the Y direction by a conveyance roller driven by a conveyance motor 209 via a gear. On the other hand, at a predetermined conveyance position, a carriage motor 208 reciprocally scans the carriage 102 along a guide shaft 103 extending in the X direction. In this reciprocal scanning, the +X direction is a forward direction, and the −X direction is a backward direction. In synchronization with a timing based on an encoder signal obtained by an encoder 106 reading, in the process of scanning, a slit provided parallel to the guide shaft 103, an ink droplet is ejected from an ejection port of the printhead 105 to print an image on the print medium P. A reflective optical sensor 107 for measuring the paper distance, which is the distance from the ejection port surface where the ejection ports of the printhead 105 are formed to the print medium P, is attached to the carriage 102.

In this embodiment, the height of the ejection port surface of the printhead 105 is equal to the Z-direction height of the reflective optical sensor 107. Similar to the printhead 105, in synchronization with a timing based on a position signal obtained by the encoder 106 in the process of reciprocal scanning of the carriage, the detection signal corresponding to the position of the carriage 102 is processed. Note that a carriage belt can be used to transmit a driving force from the carriage motor 208 to the carriage 102. Instead of the carriage belt, another driving method may be used, such as a configuration including, for example, a lead screw extending in the X direction and rotationally driven by the carriage motor 208, and an engaging portion provided in the carriage 102 and engaging with the groove of the lead screw. Note that the above-described reciprocal scanning includes an operation in which the carriage moves in a direction (forward direction) away from the home position of the carriage, and an operation in which the carriage moves in a direction (backward direction) toward the home position of the carriage.

The fed print medium P is nipped and conveyed by a feeding roller (not shown) and a pinch roller (not shown), and guided to a printing position (the scanning area of the printhead) on a platen 104. Normally, the ink ejection port surface of the printhead 105 is capped in a sleep state. Hence, prior to printing, a cap (not shown) is released and the carriage 102 is set in a scannable state. After that, when data for one scanning is stored in a buffer, the carriage motor 208 scans the carriage 102 to perform printing as described above.

A controller 200 includes, for example, a CPU 201 in a form of a microcomputer, a ROM 202 storing programs, necessary tables, and other permanent data, and a RAM 203 providing an area for deploying image data, a work area, and the like. On the other hand, a host apparatus 210 is an image data supply source. The host apparatus 210 may be in a form of a computer which performs, for example, creation and processing of data such as an image regarding printing, or may be in a form of a scanner, a digital camera, or the like for image reading. Image data, other commands, status signals, and the like are transmitted/received to/from the controller 200 via an interface (I/F) 211. A power switch 212 turns on/off power supply to the printing apparatus.

A motor driver 205 is a driver for driving the carriage motor 208, and a motor driver 206 is a driver for driving the conveyance motor 209. A head driver 204 is a driver that drives the printhead 105 in accordance with print data or the like. The head driver 204 includes a shift register which aligns image data so as to correspond to the ejection ports of the printhead 105, a latch circuit which latches the data at an appropriate timing, and a logic circuit which drives a heater arranged for each ejection port in synchronization with a driving timing signal.

The CPU 201 stores, in the RAM 203, an adjustment value used to adjust the printing position based on the position signal from the encoder 106 and the paper distance information from the reflective optical sensor 107. The CPU 201 uses the adjustment value stored in the RAM 203 to control the timing of ejecting an ink droplet from the printhead 105 via the head driver 204, and adjust the printing position.

In the vicinity of the home position of the carriage 102, a recovery unit 207 that performs a recovery operation of the printhead 105 is provided.

Figure 3:
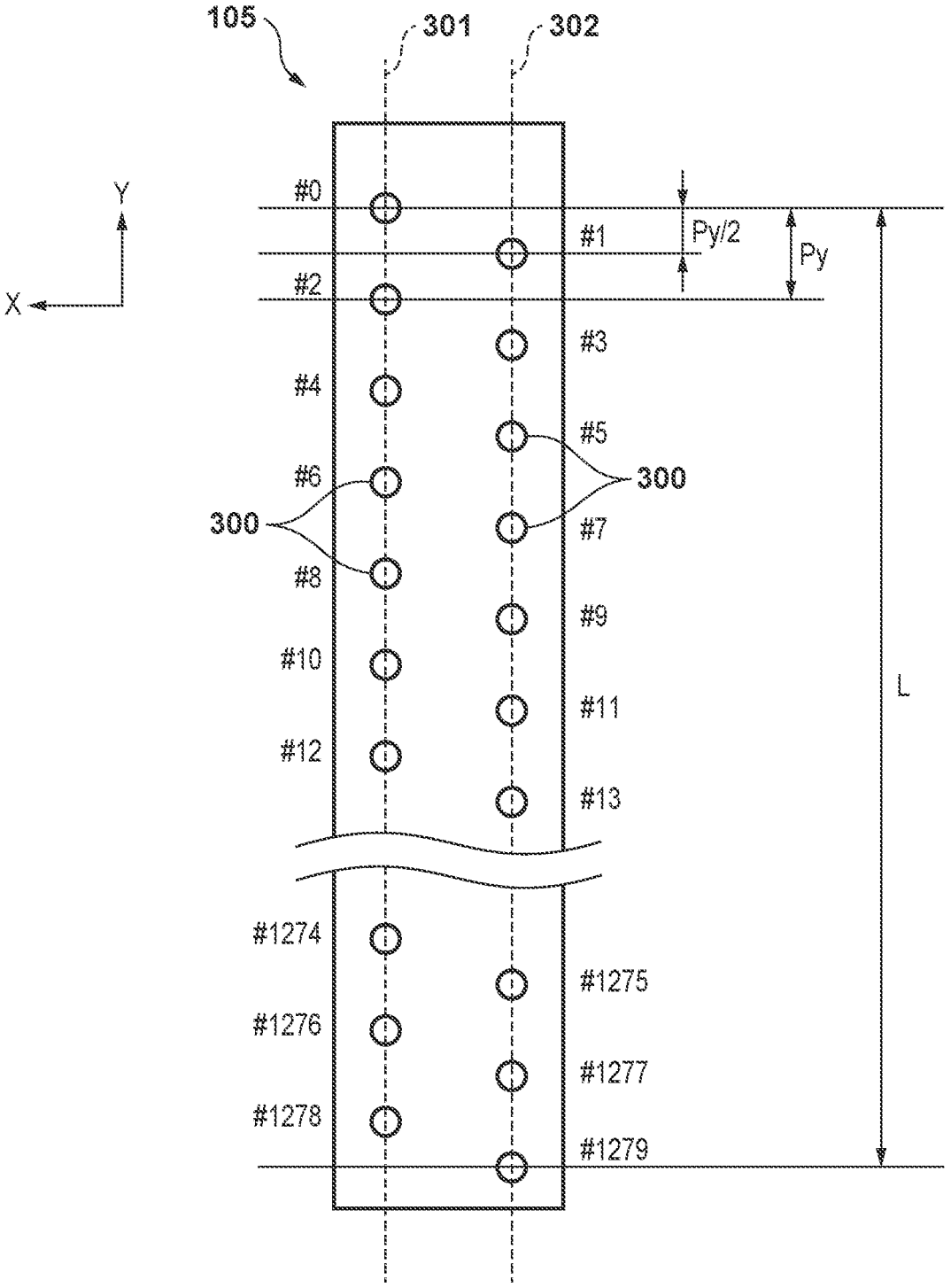
FIG. 3 is a view showing the arrangement of ejection port arrays provided in the ink ejection port surface of a printhead.

FIG. 3 is a view showing the arrangement of ejection port arrays provided in the ink ejection port surface of the printhead 105.

As shown in FIG. 3, in the printhead 105, a plurality of ejection ports 300, each of which ejects ink, are formed in two arrays (to be referred to ejection port arrays hereinafter) 301 and 302. The ejection port arrays 301 and 302 extend in the Y direction (subscanning direction) in which the print medium is conveyed. Note that the direction of the ejection port array need not match the Y direction, and may be a direction intersecting the Y direction.

640 ejection ports 300 are formed in each of the ejection port arrays 301 and 302 with a pitch Py set to the interval corresponding to a resolution of 600 dpi. The ejection ports 300 in the ejection port array 301 are shifted from the ejection ports 300 in the ejection port array 302 in the Y direction by half the pitch (Py/2) corresponding to a resolution of 1,200 dpi. The odd-numbered ejection ports located at odd-numbered positions in the Y direction are arrayed in one of the ejection port arrays 301 and 302, and the even-numbered ejection ports located at even-numbered positions are arrayed in the other ejection port array. The X direction is the reciprocal scanning direction of the printhead 105.

When a total of 1,280 ejection ports 300 in the two arrays eject ink of the same color, an image can be printed with a dot density of 1,200 dpi in the Y direction. In FIG. 3, L indicates the total length of the ejection ports, and ejection port numbers #0, #1, #2, #3, . . . , #1278, and #1279 are assigned from the +Y direction.

Figure 4:
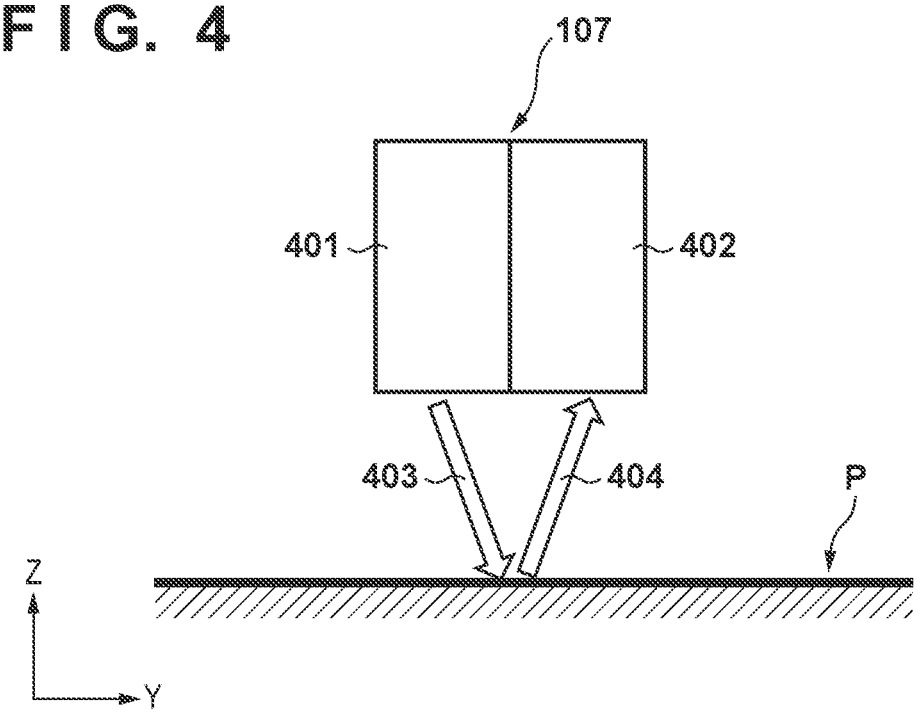
FIG. 4 is a schematic view for explaining paper distance measurement performed by a reflective optical sensor shown in FIG. 1.

FIG. 4 is a schematic view for explaining paper distance measurement performed by the reflective optical sensor 107 shown in FIG. 1.

The reflective optical sensor 107 is attached to the carriage 102 as described above, and includes a light-emitting unit 401 and a light-receiving unit 402 as shown in FIG. 4. Light 403 emitted from the light-emitting unit 401 is reflected by the print medium P facing the light-emitting unit 401, and reflected light 404 can be detected by the light-receiving unit 402 facing the print medium P. A detection signal (analog signal) of the reflected light 404 obtained by the light-receiving unit 402 is transmitted to the controller 200 of the printing apparatus via a flexible cable (not shown). Then, the detection signal is converted into a digital signal by an A/D converter (not shown) incorporated in the controller 200, and stored in the RAM 203 as paper distance information.

Next, some embodiments of printing control in which paper distance adjustment processing is performed using the printing apparatus and printhead configured as described above will be described.

First Embodiment

Figure 5:
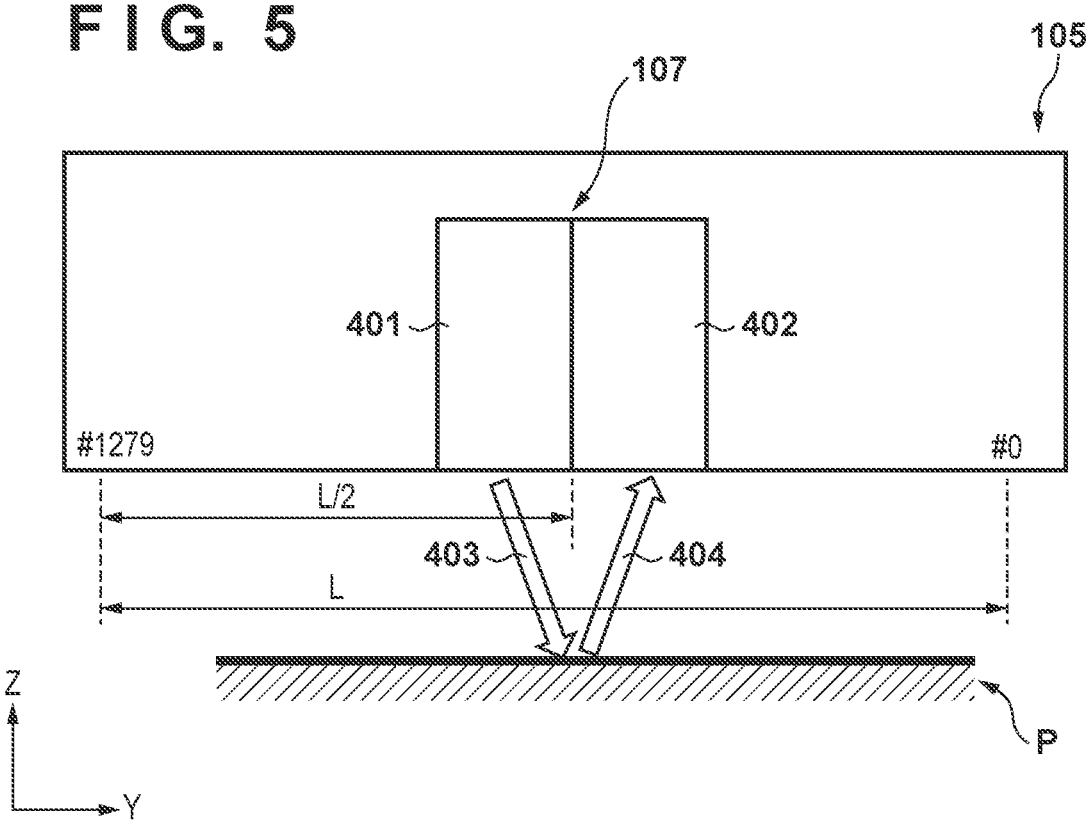
FIG. 5 is a view showing the positional relationship between ejection port arrays of a printhead and a reflective optical sensor.

FIG. 5 is a view showing the positional relationship between ejection port arrays of a printhead 105 and a reflective optical sensor 107. As shown in FIG. 5, the reflective optical sensor 107 is arranged almost in the central portion for the ejection ports #0 to #1279 (total length L).

Figure 6A:
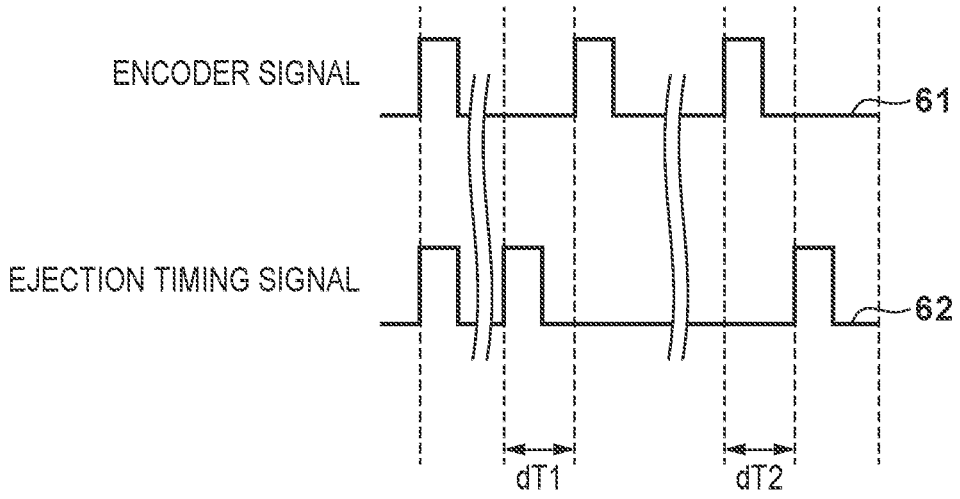
FIG. 6A is a timing chart showing a position signal output by an encoder and an ejection timing signal.
Figure 6B:
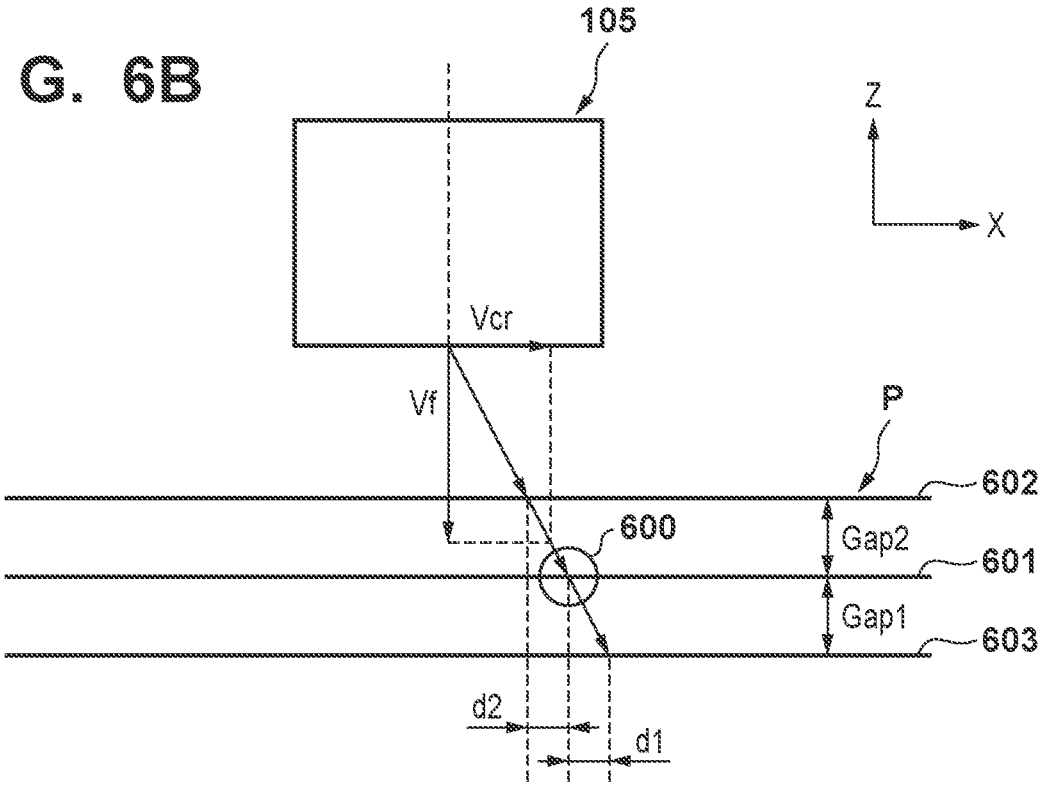
FIG. 6B is a view showing the relationship between the drop positions on a print medium.

FIGS. 6A and 6B are views showing the relationship among the position signal output by an encoder 106, the ejection timing signal, and the drop position on a print medium P.

In FIG. 6A, reference numeral 61 indicates the position signal output by the encoder 106, that is, the encoder signal indicating the position of a carriage 102 in the X direction, and reference numeral 62 indicates the ejection timing signal indicating the ink ejection timing from the printhead 105 in synchronism with the encoder signal. FIG. 6A shows three examples of the ejection timing signals. The first example from the left is the example in which the ejection timing signal is transmitted in synchronism with the encoder signal, and the second example from the left is the example in which the ejection timing signal is earlier than the encoder signal by a time dT1. The third example from the left is the example in which the ejection timing signal is delayed from the encoder signal by a time dT2.

FIG. 6B shows the drop positions for three paper distances of the print medium P. Particularly, FIG. 6B shows the fly direction of an ink droplet and the drop position on the print medium P in a case in which the ink droplet is ejected at an ejection velocity Vf while the printhead 105 is moving in the +X direction at a velocity Vcr. In FIG. 6B, reference numeral 601 indicates a reference paper distance, and the encoder signal and the ejection timing signal are synchronized. As a result of the ink droplet flying in a combined vector direction of the carriage velocity Vcr and the ink ejection velocity Vf, the ink droplet drops at a target drop position 600.

For a paper distance 602 which is smaller than the reference paper distance, the ink droplet drops at a position in the −X direction from the target drop position. Hence, it is necessary to delay the ejection timing by the time dT2 corresponding to the shift amount (d2) from the target drop position. On the other hand, for a paper distance 603 which is larger than the reference paper distance, the ink droplet drops at a position in the +X direction from the target drop position. Hence, it is necessary to set the ejection timing earlier by the time dT1 corresponding to the shift amount (d1) from the target drop position.

Here, if Gap2 is the distance between the reference paper distance 601 and the paper distance 602, and Gap1 is the distance between the reference paper distance 601 and the paper distance 603, dT1 and dT2 are calculated as follows. That is, $$dT1=d1/Vcr=(Gap1/Vf\times Vcr)/Vcr=Gap1/Vf$$

$$dT2=d2/Vcr=(Gap2/Vf\times Vcr)/Vcr=Gap2/Vf$$

For example, if Gap1=Gap2=200 μm, Vf=10 m/sec, and Vcr=25 inches/sec, dT1=−20 μsec and dT2=+20 μsec. In this manner, by shifting the ejection timing signal from the encoder signal based on the paper distance information indicating the different from the reference paper distance, it is possible to make an ink droplet drop at the target drop position.

Figure 7:
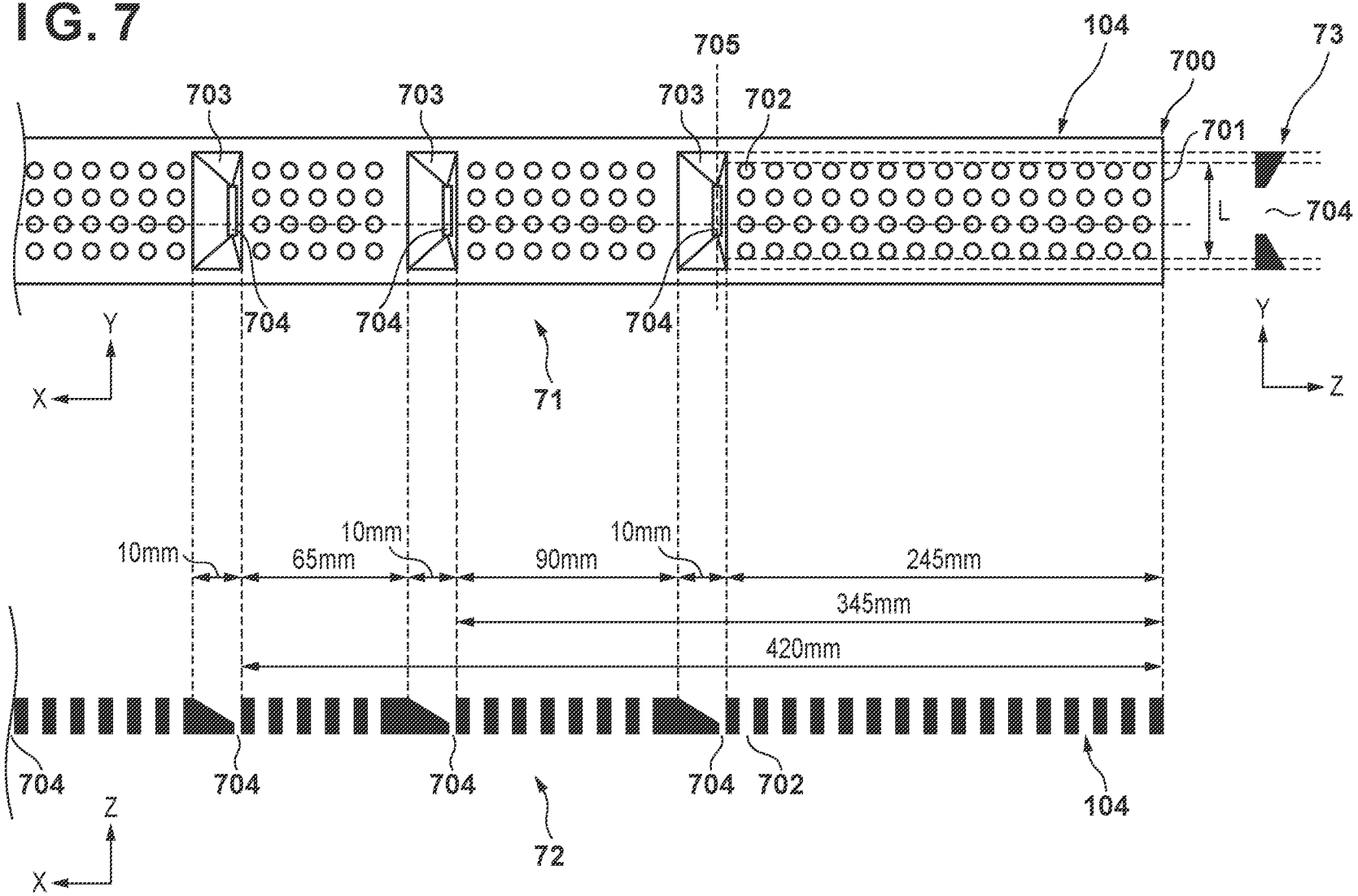
FIG. 7 shows views of the shape and structure of a platen.

FIG. 7 shows views of the shape and structure of a platen 104.

In FIG. 7, 71 is a top view of the platen viewed from the Z direction, 72 is a sectional view showing the section taken along a dashed line 701 shown in FIG. 7 when viewed from the Y direction, and 73 is a sectional view showing the section taken along a dashed line 705 shown in FIG. 7 when viewed from the X direction. By sucking air through a plurality of holes 702 formed in the platen 104 shown in 71 and 72 of FIG. 7, the print medium P is chucked and held. In 71 of FIG. 7, reference numeral 700 indicates the origin in the X direction corresponding to the end portion of the print medium regardless of the size (width) of the print medium.

As shown in 71 of FIG. 7, a plurality of ejected ink receiving ports (to be referred to as preliminary ejection ports hereinafter) 703, each having a width of 10 mm in the X direction, for preliminary ejection are arranged in accordance with a plurality of paper sheet widths. More specifically, the first preliminary ejection port is arranged at a position 245 mm from the origin 700 in the X direction, the second preliminary ejection port is arranged at a position 345 mm therefrom, and the third preliminary ejection port is arranged at a position 420 mm therefrom. Here, although a description of a preliminary ejection port arranged on the left side of the third preliminary ejection port is omitted, the preliminary ejection port is arranged at an appropriate position in accordance with the X-direction size of the printing apparatus and the acceptable size of the print medium.

As shown in 72 and 73 of FIG. 7, the inside of the preliminary ejection port 703 is inclined toward an ejected ink collection port 704 so that it can recover the ink. Due to a pressure generated by driving a fan provided on the other side of the print medium supporting side of the platen 104, the print medium P is chucked to the platen 104 via the suction port holes 702. At this time, since the pressure generated by the fan also passes through the ejected ink collection port 704, the print medium P is also chucked by the pressure from the ejected ink collection port 704. Here, the preliminary ejection port 703 is set to be sufficiently large with respect to the length (L) for the ejection port arrays of the printhead 105, and designed to be capable of receiving the ink droplets ejected from the ejection ports. The ejected ink collection port 704 in this embodiment is arranged near the center of the ejection port array of the printhead.

Figure 8:
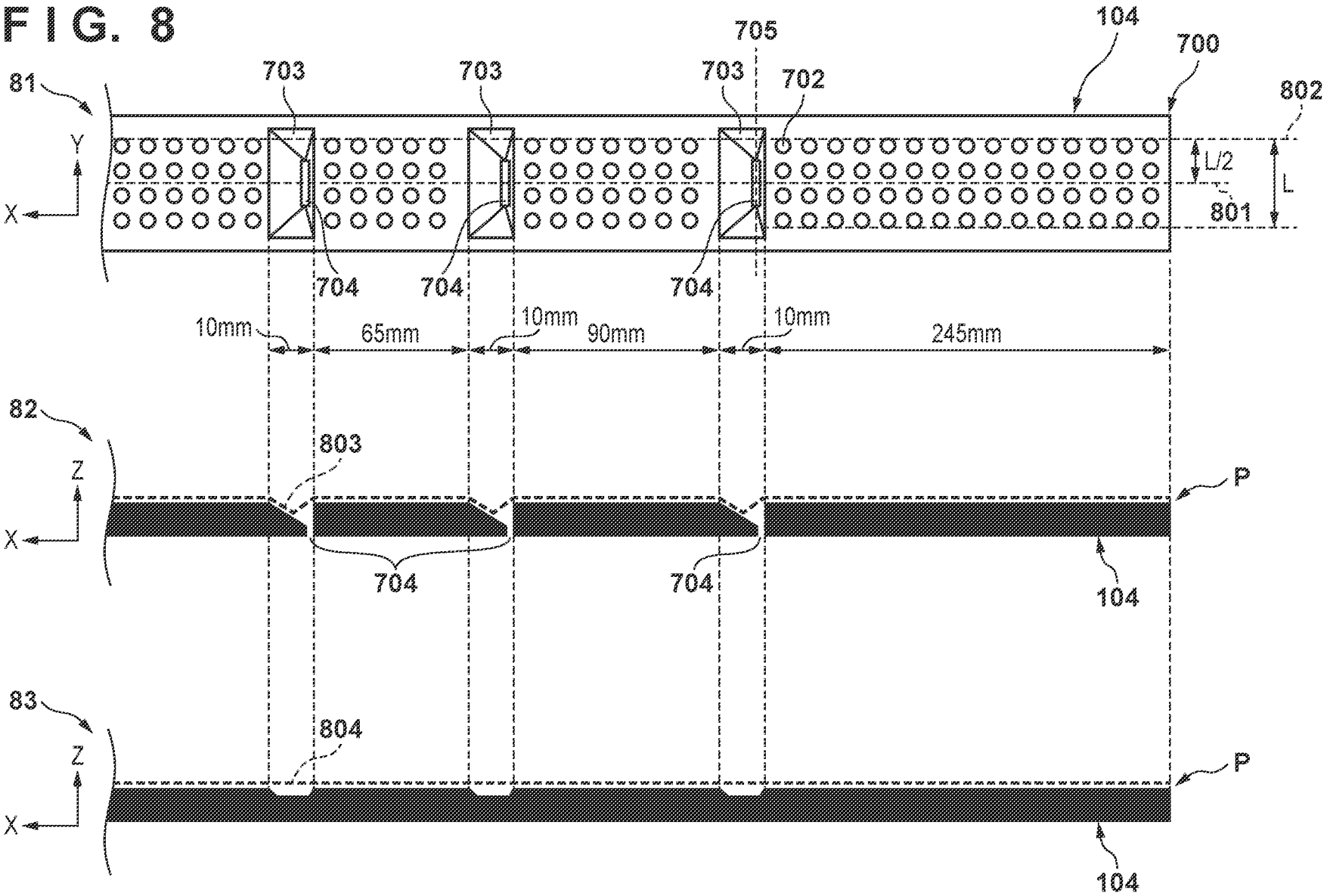
FIG. 8 shows views of fluctuation in paper distance of the print medium in the carriage moving direction (X direction) in each of the portion near the central portion of the ejection port array of the printhead and the portion near the end portion of the ejection port array during conveyance of the print medium.

FIG. 8 shows views of fluctuation in paper distance of the print medium in the carriage moving direction (X direction) in each of the portion near the central portion of the ejection port array of the printhead and the portion near the end portion of the ejection port array during conveyance of the print medium. Note that in FIG. 8, the same components as those already described with reference to FIG. 7 have the same reference numerals, and a description thereof will be omitted.

In FIG. 8, 81 is the same view as 71 of FIG. 7. 82 is a sectional view showing the section taken along a dashed line 801 indicating the portion near the central portion of the ejection port array of the printhead shown in 81 of FIG. 8 when viewed from the Y direction. 83 is a view showing the section taken along a dashed line 802 indicating the portion near the end portion of the ejection port array of the printhead when viewed from the Y direction. In 82 of FIG. 8, the fluctuation in paper distance of the print medium P on the platen 104 is indicated by a dashed line 803. In 83 of FIG. 8, the fluctuation in paper distance of the print medium P on the platen 104 is indicated by a dashed line 804.

As is apparent from comparison of 82 and 83 of FIG. 8, in the portion near the central portion of the ejection port array of the printhead, the fluctuation in paper distance of the print medium P is locally large since the print medium is sucked to the preliminary ejection port 703 by suction from the ejected ink collection port 704. On the other hand, in the portion near the end portion of the ejection port array of the printhead, since the print medium is less sucked to the preliminary ejection port 703, the local fluctuation in paper distance is small. In this manner, it can be found that, due to the influence of the preliminary ejection port 703, the fluctuation in paper distance is largely different in the X direction between the central portion of the ejection port array of the printhead 105 and the end portion thereof.

Figure 9A:
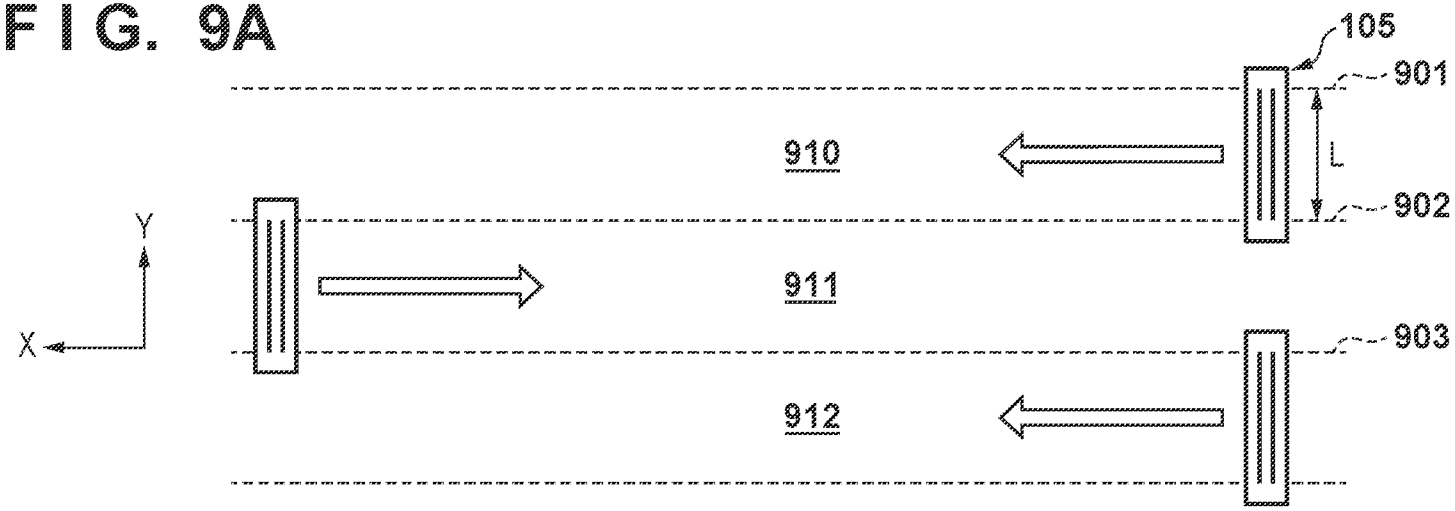
FIG. 9A is a view for explaining single-pass recording performed by the printhead.
Figure 9B:
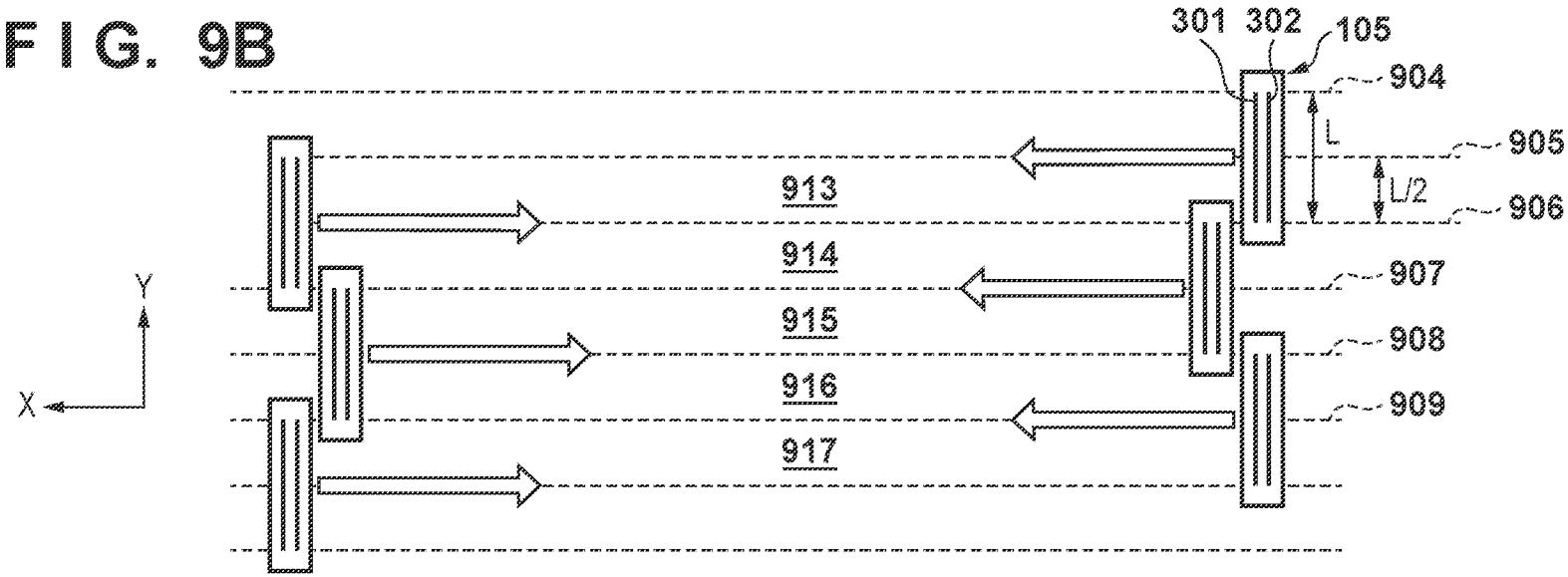
FIG. 9B is a view for explaining two-pass recording performed by the printhead.

FIGS. 9A and 9B are views for explaining single-pass recording and two-pass recording performed by the printhead. FIG. 9A explains the single-pass recording, and FIG. 9B explains the two-pass recording. Note that in this embodiment, the carriage velocity is the same in the single-pass recording and the two-pass recording. The number of recording passes is determined by the CPU 201 based on a mode set by the user and the type of a print medium used for recording, and information of the number of recording passes is stored in the RAM 203. In a case of recording, the CPU 201 controls the head driver 204 and the motor driver 205 according to the information of the number of recording passes stored in the RAM 203 and performs printing.

According to FIG. 9A, in the single-pass recording, a band 910 is printed while moving the printhead 105 in the arrow direction (+X direction) at a Y-direction position (dashed line) 901 of the printhead 105. Then, the print medium P is conveyed by a conveyance amount L corresponding to the length for the ejection port arrays of the printhead, so that the printhead 105 is moved to a Y-direction position (dashed line) 902 with respect to the print medium P. After that, a band 911 is printed while moving the printhead 105 in the arrow direction (−X direction). Further, the print medium P is conveyed by the conveyance amount L corresponding to the length for the ejection port arrays of the printhead, so that the printhead 105 is moved to a Y-direction position (dashed line) 903 with respect to the print medium P. After that, a band 912 is printed while moving the printhead 105 in the arrow direction (+X direction). By repeating the operation as described above, the single-pass reciprocal recording is performed, and an image is completed. Each of the bands 910 to 912 is an area printed by a single scanning of the printhead, so that is also referred to as a unit area.

In the single-pass recording, the connecting portion between the respective bands is formed by ink droplets ejected from the ejection ports (#0 and #1279) in the end portions of the ejection port arrays. Therefore, the drop accuracy of the ink droplet ejected from the ejection port in the end portion of the ejection port array greatly influences the image quality (particularly, the quality of a ruled line extending in the Y direction).

According to FIG. 9B, a band 913 (only the ejection ports #640 to #1279 eject the ink) is printed while moving the printhead 105 in the arrow direction (+X direction) at a Y-direction position 904 of the printhead 105. Then, the print medium P is conveyed by a conveyance amount L/2, so that the printhead is moved to a Y-direction position (dashed line) 905 with respect to the print medium P. After that, the band 913 and a band 914 are printed while moving the printhead 105 in the arrow direction (−X direction). In the same manner as described above, an operation of performing the two-pass recording of other bands 914 to 917 is repeated while conveying the print medium P by the conveyance amount L/2 for each printing scanning to move the printhead to each of Y-direction positions (dashed lines) 906, 907, 908, and 909. Thus, the two-pass reciprocal recording is performed and an image is completed. Each of the bands 914 to 917 corresponds to a part of the above-described unit area.

In the two-pass recording, each band is formed by ink droplets ejected from the ejection ports in the central portion of the ejection port array of the printhead and ink droplets ejected from the ejection ports in the end portion thereof. Accordingly, both of the drop accuracy of the ink droplet ejected from the ejection port in the central portion of the ejection port array and the drop accuracy of the ink droplet ejected from the ejection port in the end portion thereof influence the image quality (particularly, the quality (line width) of a ruled line and the graininess). Therefore, it is necessary to perform appropriate drop position correction in consideration of the influence of the drop position to the image quality in the above-described printing method.

Figure 10B:
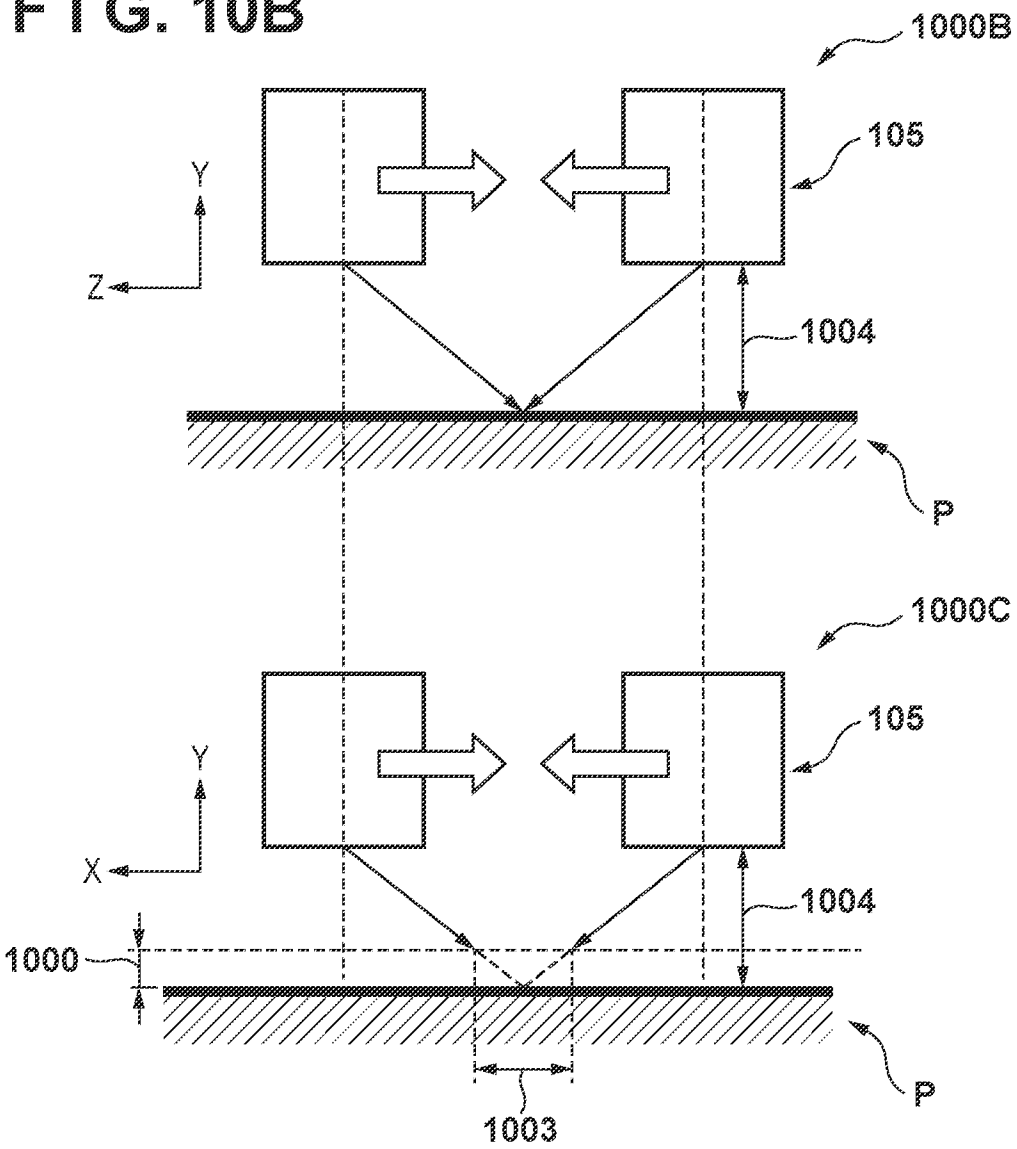
FIG. 10B is a view showing states showing the ink droplet drop positions during reciprocal printing at two different positions in the preliminary ejection port.
Figure 10A:
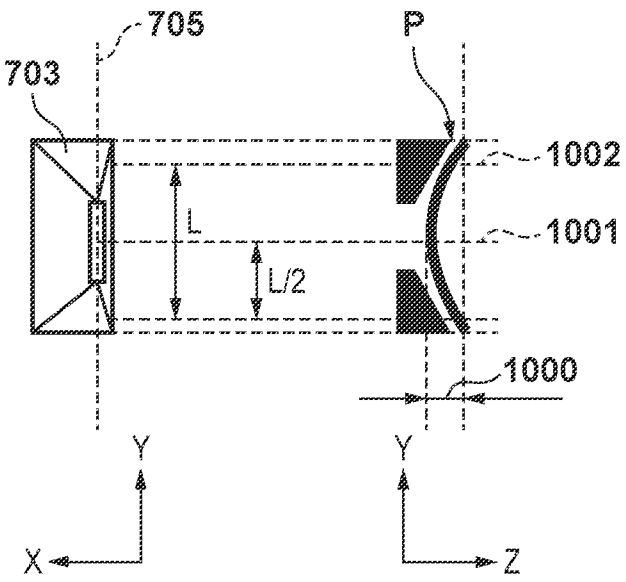
FIG. 10A is a view including a top view of the platen showing a preliminary ejection port when viewed from the Z direction and a sectional view of the platen when viewed from the X direction, and showing the behavior of a print medium P.

FIG. 10A is a view including a top view of the platen showing the preliminary ejection port when viewed from the Z direction and a sectional view of the platen when viewed from the X direction, and showing the behavior of the print medium P. FIG. 10B is a view showing states showing the ink droplet drop positions during reciprocal printing at two different positions in the preliminary ejection port. The top view of the preliminary ejection port 703 is shown on the left side in FIG. 10A, and the sectional view of the preliminary ejection port 703 taken along the dashed line 705 is shown on the right side in FIG. 10A. 1000B in FIG. 10B is an ink droplet drop state at a position on a dashed line 1001 in FIG. 10A, and 1000C in FIG. 10B is an ink droplet drop state at a position on a dashed line 1002 in FIG. 10A.

According to the state 1000B in FIG. 10B, the ink droplets during the reciprocal printing with a paper distance 1004 performed by the printhead drop at a target drop position on the print medium P. On the other hand, the state 1000C in FIG. 10B shows the flying states and the drop positions on the print medium P of respective ink droplets, which are ejected at the same timing as in the case of the position 1001, during the reciprocal printing performed with the position 1002 which is closer to the ejection port than the position 1001 by a paper distance 1000. As can be seen from the state in FIG. 10C, when the paper distance is decreased, the drop positions are shifted from each other by a distance 1003. Thus, when the reciprocal printing is performed using the same ejection timing, a drop shift occurs between the central portion and the end portion of the ejection port array of the printhead. The positional relationship between the printhead 105 and the reflective optical sensor 107 is shown in FIG. 5. However, the paper distance detected by the reflective optical sensor 107 is the paper distance in the portion near the central portion of the ejection port array of the printhead 105, and this may be different from the paper distance in the portion near the end portion of the ejection port array.

As has been described with reference to FIGS. 9A and 9B, in the single-pass recording, if the paper distance measured by the reflective optical sensor 107 (near the central portion of the ejection port array) is used, the drop shift corresponding to the distance 1003 in the portion near the end portion of the ejection port array causes a deterioration in image quality (a ruled-line shift of a vertical ruled line in the Y direction). Therefore, it is necessary to perform control based on the paper distance information in consideration of fluctuation in paper distance in the end portion of the ejection port array of the printhead 105.

Figure 11A:
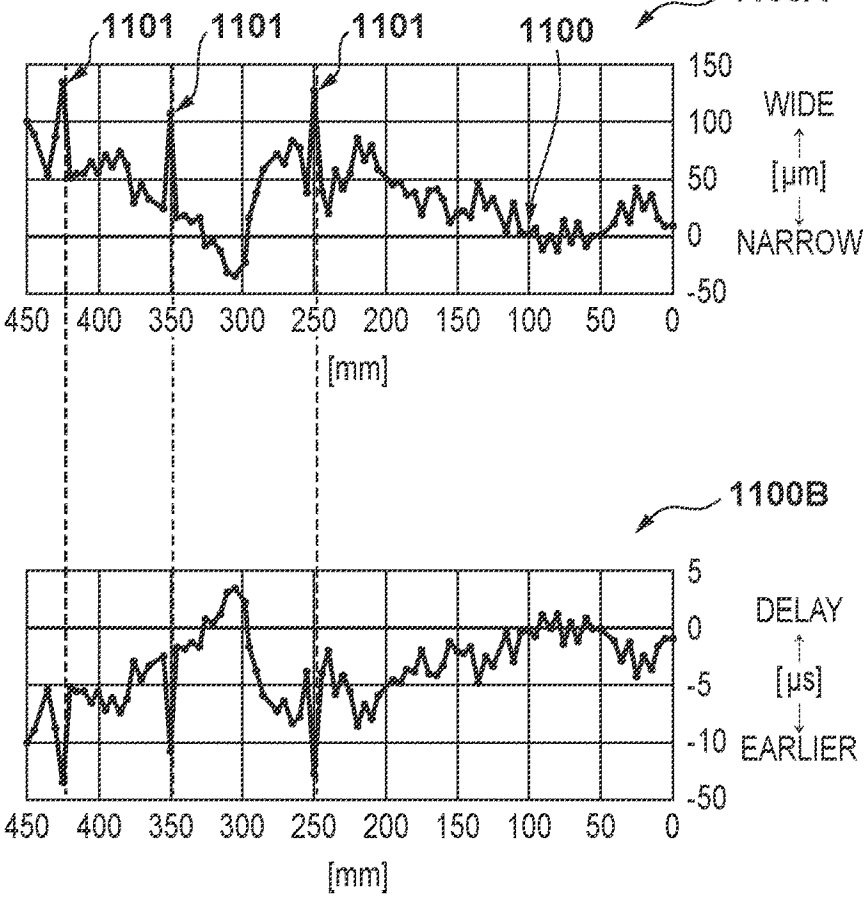
FIGS. 11A and 11B are graphs for explaining the behavior of the paper distance detected by the reflective optical sensor and an ejection timing calculation method.
Figure 11B:
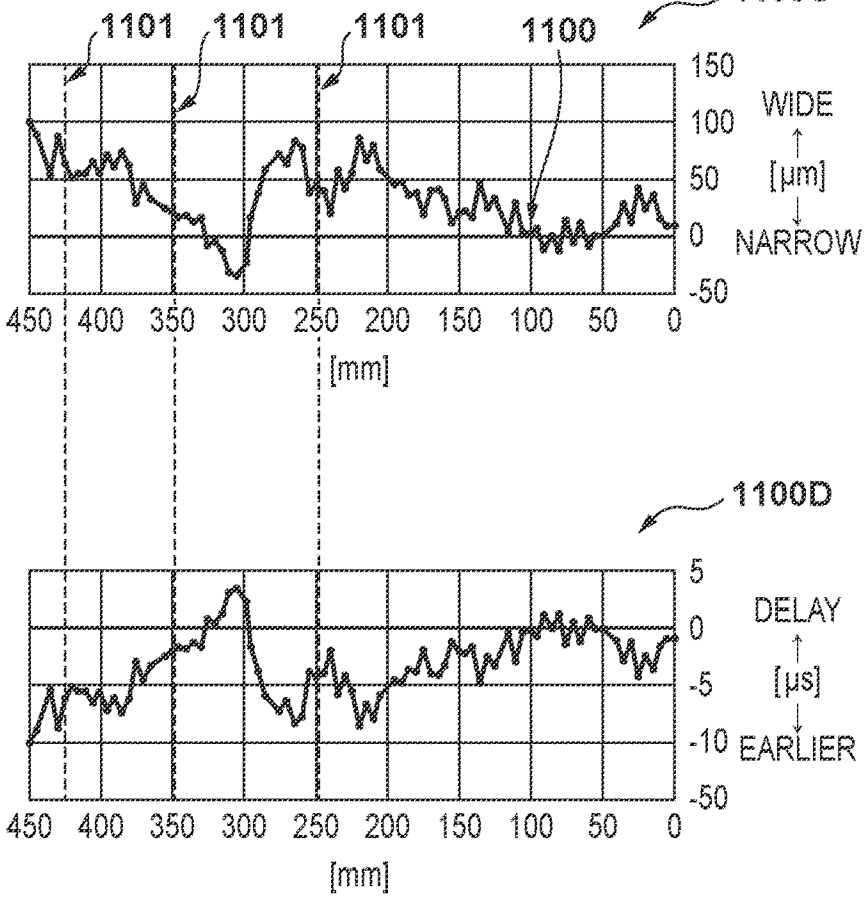

FIGS. 11A and 11B are graphs for explaining the behavior of paper distance detected by the reflective optical sensor and an ejection timing calculation method. In this embodiment, the paper distance information detected by the reflective optical sensor 107 is obtained at an interval of 5 mm in the X direction. Note that, here, the paper distance information obtained at the interval of 5 mm is the information having undergone noise removal through various kinds of averaging processing operations. Therefore, it is necessary to optimize the paper distance information in accordance with the moving velocity of the printhead and the reading interval of the reflective optical sensor.

In FIG. 11A, 1100A indicates the paper distance information detected by the reflective optical sensor 107 provided at the position indicated by the dashed line 801 in 81 of FIG. 8, and 1100B indicates the ejection timing calculated based on the paper distance information indicated by 1100A in a manner similar to that of the ejection timing signal 62 shown in FIG. 6A. 1100C in FIG. 11B indicates the paper distance information obtained by correcting the paper distance information near the preliminary ejection port while assuming the behavior of the paper distance near the end portion of the ejection port array described with reference to FIGS. 10A and 10B based on the paper distance information indicated by 1100A in FIG. 11A, and 1100D indicates the ejection timing calculated based on the paper distance information indicated by 1100C. In FIGS. 11A and 11B, the abscissa represents the X-direction position of the platen. Similar to the origin 700 in 71 of FIG. 7, an origin 0 corresponds to the position of the end portion of the print medium. In this embodiment, the moving velocity (Vcr) of the printhead 105 is 25 inches/sec, and the ejection velocity (Vf) of the ink droplet from the printhead 105 is 10 m/sec.

Here, with reference to FIG. 11A, a conventional drop position correction processing method based on the paper distance information will be described.

Although a detailed description will be omitted, the drop position correction for the reciprocal printing is performed at a position 1100 as in the conventional printing apparatus. Therefore, the X-direction drop position correction is controlled based on the displacement amount obtained with reference to the paper distance and the ejection timing at the position 1100. As indicated by 1100A, it can be seen that the paper distance sharply increases at a position 1101 of the preliminary ejection port. In accordance with this, as indicated by 1100B, at the position of the preliminary ejection port, the ejection timing is set earlier than the ejection timing at the position 1100 used as the reference.

However, if printing is performed using the ejection timing indicated by 1100B, in the single-pass recording described with reference to FIG. 9A, an X-direction shift in drop position of slightly less than 100 μm occurs in the end portion of the ejection port array. Thus, if a Y-direction ruled line is printed, a ruled-line shift occurs. Therefore, in this embodiment, as indicated by 1100C in FIG. 11B, assuming that fluctuation in paper distance is small near the end portion of the ejection port array, the paper distance information at the position 1101 of the preliminary ejection port is changed.

More specifically, the pieces of paper distance information at a total of four positions including two forward positions and two backward positions in the X direction from the position 1101 of the preliminary ejection ports are averaged, and the average value is replaced as the paper distance information at the position 1101 of the preliminary ejection port. With this operation, it is possible to create the paper distance information close to the behavior of the paper distance in the end portion of the ejection port array. Further, based on the paper distance information indicated by 1100C in FIG. 11B, ejection timing information indicated by 1100D is calculated.

Here, an application method of the pieces of ejection timing information (the ejection timing information indicated by 1100B in FIG. 11A and the ejection timing information indicated by 1100D in FIG. 11B) calculated based on the paper distance information indicated by 1100A in FIG. 11A and the paper distance information indicated by 1100C in FIG. 11B, respectively, in consideration of the printing methods and the influences of the shift in drop position described with reference to FIGS. 9A and 9B will be described.

That is, in the single-pass recording (FIG. 9A), the drop accuracy of the ink droplet ejected from the ejection port in the end portion of the ejection port array of the printhead greatly influences the image quality (particularly, the quality of a ruled line extending in the Y direction). Therefore, the ejection timing correction indicated by 1100D in FIG. 11B is performed.

On the other hand, in the two-pass recording (FIG. 9B), both of the drop accuracy of the ink droplet ejected from the ejection port in the central portion of the ejection port array of the printhead and the drop accuracy of the ink droplet ejected from the ejection port in the end portion thereof influence the image quality (particularly, the quality (line width) of a ruled line and the graininess). Therefore, the ejection timing correction indicated by 1100B in FIG. 11A is performed as in the conventional manner.

Thus, according to the embodiment described above, by changing the ejection timing correction method between the single-pass recording and the two-pass recording, it is possible to implement the high-quality printing without a large deterioration in image quality in both the single-pass recording and the two-pass recording.

Note that in the embodiment described above, the two-pass recording has been described as multiple-pass recording, but the number of recording passes is not limited to this. Even when the multiple-pass recording such as four-pass, six-pass, eight-pass, or 16-pass recording is performed, the ejection timing correction indicated by 1100D in FIG. 11B can be performed as in the above-described method for the two-pass recording.

Also in the multiple-pass recording, for example, in a case in which the ejection amount in the end portion of the ejection port array is large and a deterioration in image quality as described for the above-described single-pass recording occurs in printing of a certain pass count, control may be performed as follows. That is, the ejection timing correction for the certain pass count may be performed using the above-described correction method for the single-pass recording, and the ejection timing correction method for the other pass count may use the above-described correction method for the two-pass recording.

The printing apparatus in the above-described embodiment has the arrangement in which the ejected ink collection port 704 is located at the position corresponding to the central portion of the ejection port array, but a printing apparatus in which the ejected ink collection port is not located in the central portion of the preliminary ejection port may be used. In this case, since fluctuation in paper distance is locally large at the position of the ejected ink collection port, the reflective optical sensor may be arranged so as to be capable of detecting the paper distance of the print medium above the ejected ink collection port, and the ejection timing correction may be performed.

Second Embodiment

The second embodiment is different from the first embodiment in that the processing of paper distance information is changed in accordance with the type of the print medium.

Figure 12A:
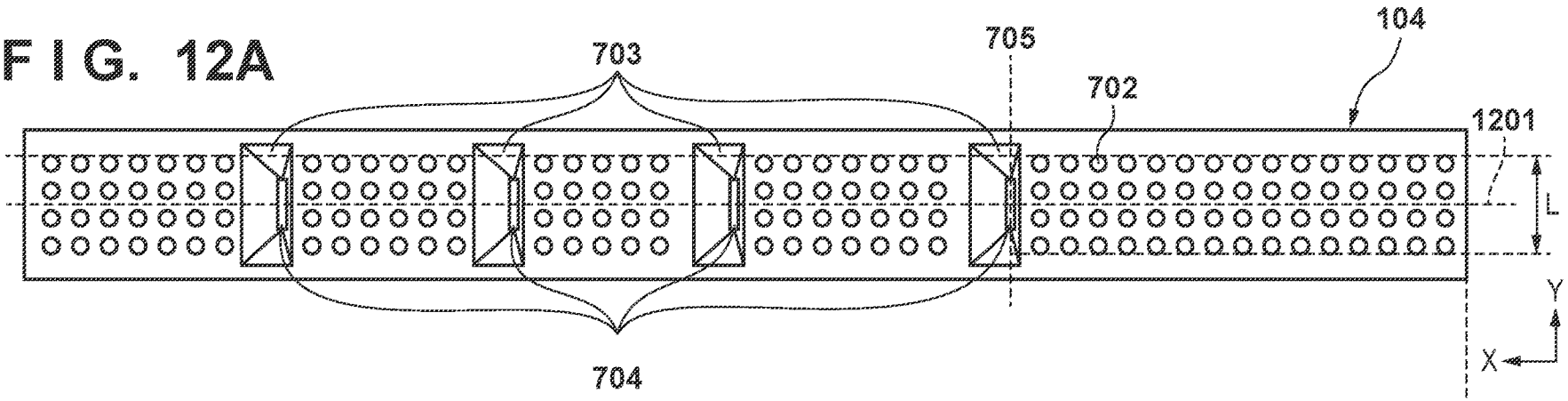
FIG. 12A is a view showing a portion near the central portion of the ejection port array of a printhead and a portion near the end portion of the ejection port array.
Figure 12B:
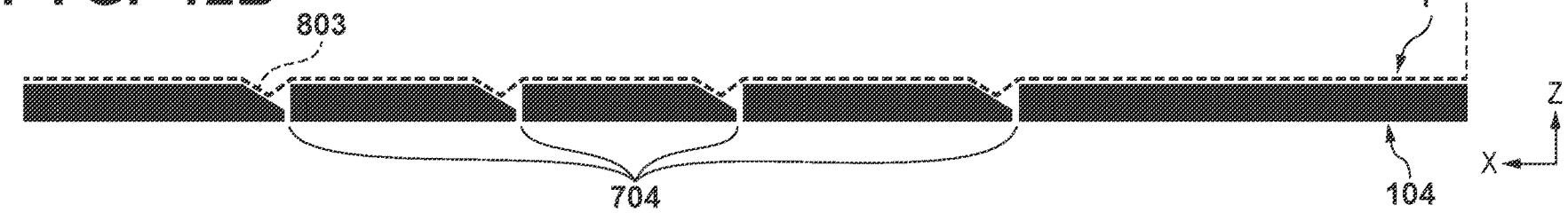
FIG. 12B is a view showing fluctuation in paper distance of a plain paper sheet on a platen.
Figure 12C:
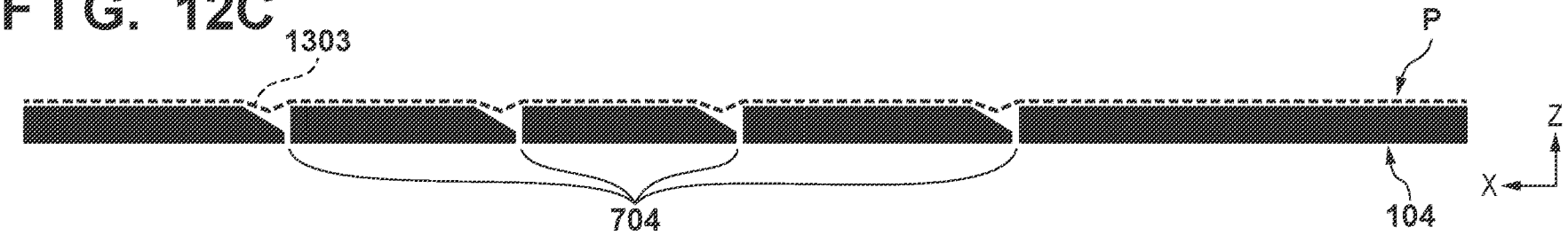
FIG. 12C is a view showing fluctuation in paper distance of a coated paper sheet on the platen.

FIG. 12A shows a portion near the central portion of the ejection port array of a printhead and a portion near the end portion of the ejection port array. FIGS. 12B and 12C are views each showing fluctuation in paper distance of a print medium in a carriage moving direction (X direction) during conveyance of the print medium, in which the type of the print medium is different between FIGS. 12B and 12C. Note that in FIGS. 12A to 12C, the same components as those already described with reference to FIGS. 7 and 8 have the same reference numerals, and a description thereof will be omitted. Note that FIG. 12A is a view similar to 71 of FIG. 7 and 81 of FIG. 8. Each of FIGS. 12B and 12C is a sectional view showing the section taken along a dashed line 1201 indicating the portion near the central portion of the ejection port array of the printhead shown in FIG. 12A when viewed from the Y direction. In FIG. 12B, the fluctuation in paper distance of a plain paper sheet P on a platen 104 is indicated by a dashed line 803. In FIG. 12C, the fluctuation in paper distance of a coated paper sheet P on the platen 104 is indicated by a dashed line 1303.

As is apparent from comparison of FIGS. 12B and 12C, in the portion near the central portion of the ejection port array of the printhead, also in the portion near a preliminary ejection port 703 where large fluctuation in paper distance in the X direction occurs, the behavior of the print medium largely changes in accordance with the rigidity of the print medium. Therefore, when a plain paper sheet, which is easily influenced by the preliminary ejection port, is used, the processing similar to that in the first embodiment is performed. On the other hand, when a coated paper sheet is used, ejection timing correction is performed regardless of the printing method based on the paper distance information detected by a reflective optical sensor 107.

Figure 13:
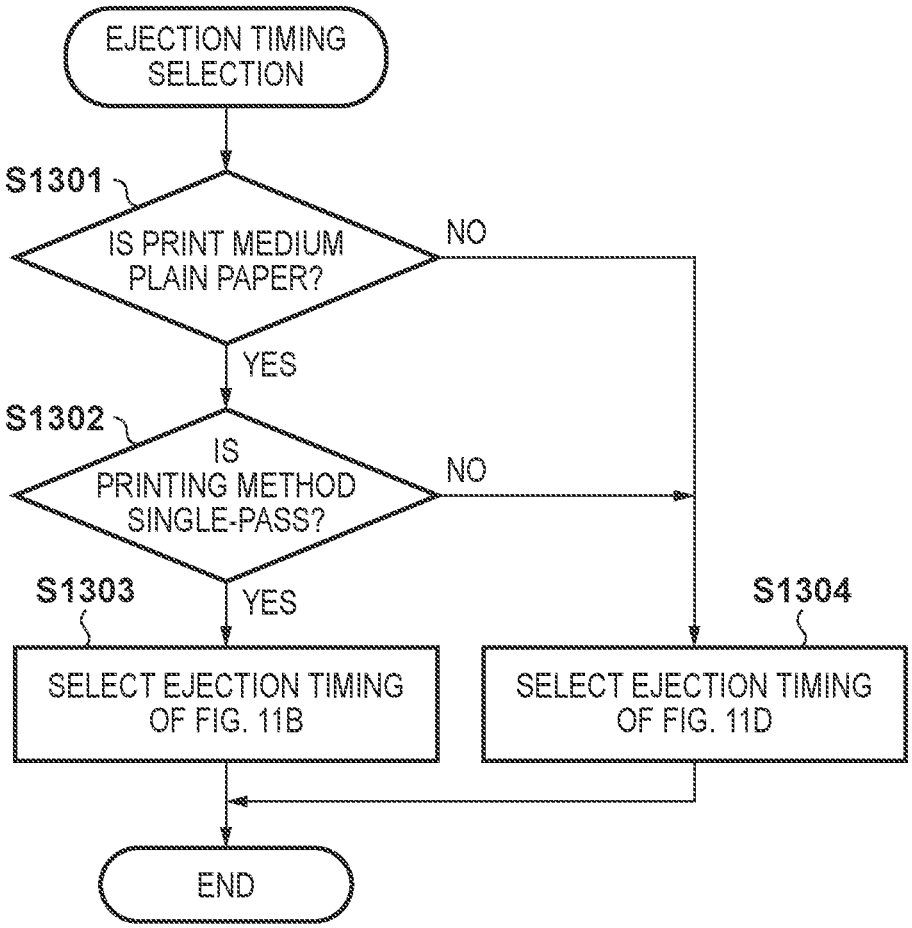
FIG. 13 is a flowchart showing the processing of selecting the ejection timing correction.

FIG. 13 is a flowchart showing the processing of selecting the ejection timing correction.

According to FIG. 13, first, in step S1301, it is checked whether the print medium to be used is a plain paper sheet. If it is determined that the print medium is a plain paper sheet, the processing advances to step S1302, and it is checked whether the printing method to be used is single-pass recording. If it is determined that the printing method is single-pass recording, the processing advances to step S1303.

In step S1303, the ejection timing indicated by 1100B in FIG. 11A is selected. That is, in a case in which the print medium to be used is a plain paper sheet and the printing method to be used is single-pass recording, the ejection timing indicated by 1100B in FIG. 11A is selected.

On the other hand, in other cases, that is, in a case in which the print medium to be used is not a plain paper sheet or in a case in which the print medium to be used is a plain paper sheet but the printing method is not single-pass recording, the ejection timing indicated by 1100D in FIG. 11B is selected in step S1304.

Thus, according to the embodiment described above, it is possible to perform printing with the appropriate ejection timing regardless of the print medium and printing method to be used. Accordingly, it is possible to reduce a deterioration in image quality at the time of single-pass recording of a plain paper sheet, which has been a problem in the conventional example.

Third Embodiment

The third embodiment is different from the first and second embodiments in that two reflective optical sensors are mounted, so that the behavior of the paper distance can be detected in both the portion near the central portion of the ejection port array of a printhead and the portion near the end portion thereof.

Figure 14:
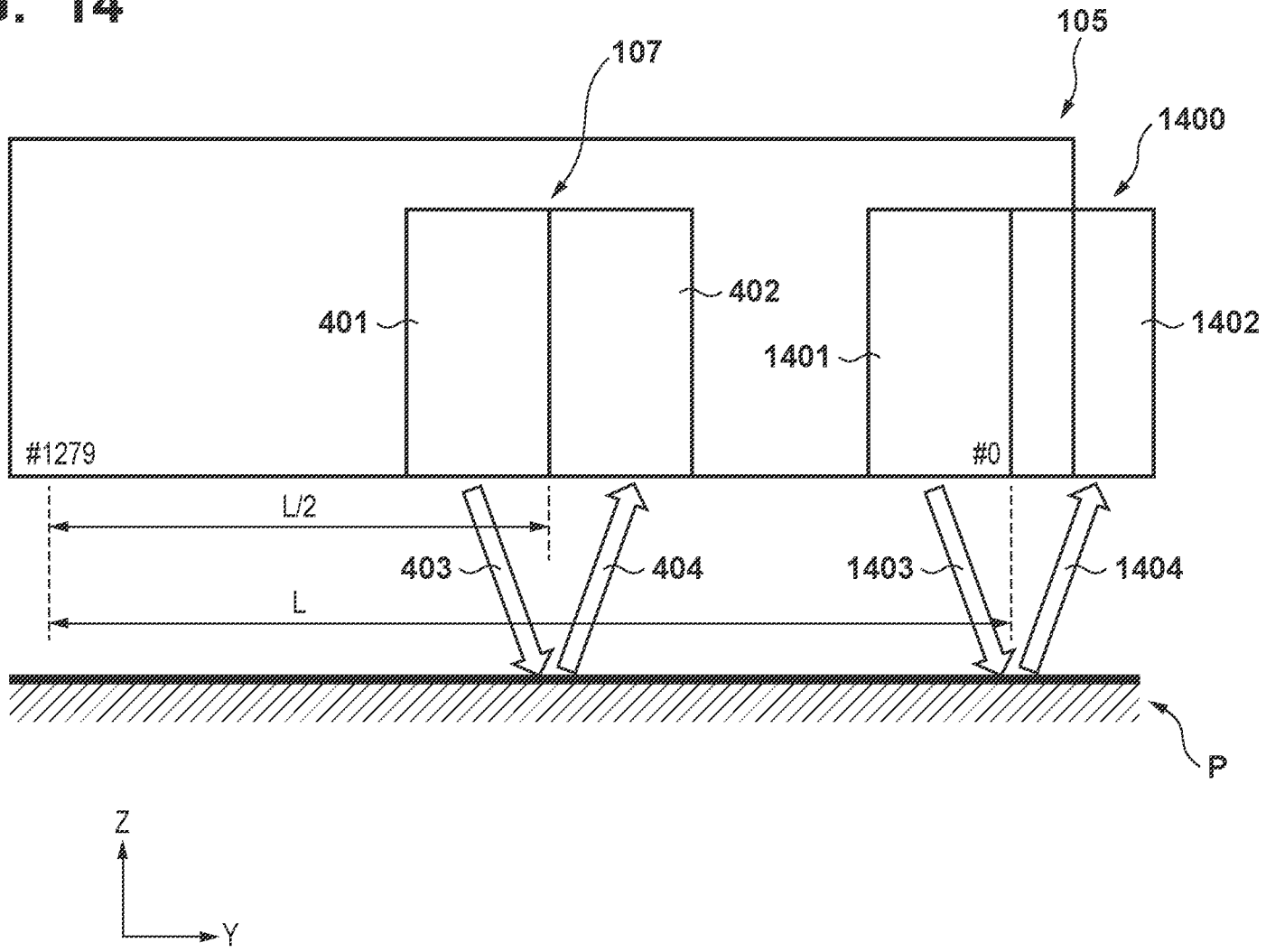
FIG. 14 is a view showing the relationship between a printhead and the mount positions of a plurality of reflective optical sensors.

FIG. 14 is a view showing the relationship between the printhead and the mount positions of a plurality of reflective optical sensors. Note that in FIG. 14, the same components as those already described with reference to FIG. 5 have the same reference numerals, and a description thereof will be omitted. As shown in FIG. 14, in addition of a reflective optical sensor 107, a reflective optical sensor 1400 is provided, which has the arrangement similar to that of the reflective optical sensor 107 and includes a light-emitting unit 1401 and a light-receiving unit 1402 in the end portion (near the ejection port #0) of the ejection port array of a printhead 105.

As shown in FIG. 14, light 1403 emitted from the light-emitting unit 1401 is reflected by a print medium P, and reflected light 1404 can be detected by the light-receiving unit 1402.

A detection signal (analog signal) generated by the light-receiving unit 1402 based on the reflected light 1404 is transmitted to a controller 200 of the printing apparatus via a flexible cable (not shown). Then, the detection signal is converted into a digital signal by an A/D converter (not shown) incorporated in the controller 200, and stored in a RAM 203 as paper distance information.

Thereafter, as described in each of the first and second embodiments, the paper distance information to be used is selected based on the type of the print medium and the printing method. Single-pass recording of a plain paper sheet is performed using the ejection timing information calculated based on the paper distance information detected by the reflective optical sensor 1400. On the other hand, each of two-pass recording of a plain paper sheet, single-pass recording of a coated paper sheet, and two-pass recording of a coated paper sheet is performed using the ejection timing information calculated based on the paper distance information detected by the reflective optical sensor 107.

Thus, according to the embodiment described above, as in the first and second embodiments, it is possible to optimize the drop position correction of the ejected ink droplet, and reduce a deterioration in image quality at the time of single-pass recording of a plain paper sheet, which has been a problem in the conventional example.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-116644, filed on Jul. 6, 2020, which is hereby incorporated by reference herein in its entirety.

What is claimed is:

1. An inkjet printing apparatus comprising:

a printhead in which a plurality of ejection ports that eject ink are formed;

a carriage mounted with the printhead and reciprocated in a predetermined direction;

a conveyance unit configured to convey a print medium on which an image is to be printed by ink droplets ejected from the printhead;

a platen extending in the predetermined direction and configured to support, at a printing position by the printhead, the print medium conveyed by the conveyance unit, the platen being provided with a receiving port configured to receive ink ejected from the printhead to a predetermined position in the predetermined direction, wherein the receiving port includes a collection port configured to collect the ink;

an obtaining unit provided in the carriage, and configured to obtain information regarding a distance from an ejection port surface of the printhead to the print medium on the platen at a plurality of positions in the predetermined direction;

a measurement unit including a sensor configured to measure the distance at a position where the collection port is provided; and a control unit configured to control an ink ejection timing from the printhead in accordance with the information regarding the distance obtained by the obtaining unit and information corresponding to the number of passes of printing, which is the number of times of reciprocating the carriage to print the image in a unit area of the print medium.

2. The apparatus according to claim 1, wherein the number of passes of printing includes a first number of passes and a second number of passes.

3. The apparatus according to claim 2, wherein printing with the first number of passes is single-pass recording, and printing with the second number of passes is multiple-pass recording.

4. The apparatus according to claim 2, wherein a speed of the carriage in image printing with the first number of passes is equal to a speed of the carriage in image printing with the second number of passes.

5. The apparatus according to claim 1, wherein the measurement unit includes another sensor configured to measure the distance at a center of an ejection port array formed by the plurality of ejection ports in a direction intersecting the predetermined direction, and wherein the obtaining unit obtains the distance measured by the measurement unit.

6. The apparatus according to claim 5, wherein in a case in which printing with the first number of passes is performed, the control unit corrects the distance at an end portion of the ejection port array based on the distance at the center of the ejection port array measured by the other sensor, and controls the ink ejection timing from the ejection port located at an end portion of the ejection port array based on the corrected distance, and in a case in which printing with the second number of passes is performed, the control unit controls the ejection timing based on the distance at the center of the ejection port array measured by the other sensor.

7. The apparatus according to claim 6, wherein the type of the print medium includes plain paper and coated paper, in a case in which the type of the print medium is plain paper and printing with the first number of passes is performed, the control unit controls to change the ink ejection timing from an ejection port located at the end portion of the ejection port array based on the corrected distance, and in at least one of a case in which the type of the print medium is coated paper and a case in which printing with the second number of passes is performed, the control unit controls the ejection timing based on the distance at the center of the ejection port array.

8. The apparatus according to claim 6, wherein in a case in which printing with the first number of passes is performed, the control unit controls the ink ejection timing from an ejection port located at the end portion of the ejection port array based on the distance at the end portion of the ejection port array measured by the sensor, and in a case in which printing with the second number of passes is performed, the control unit controls the ejection timing based on the distance at the center of the ejection port array measured by the other sensor.

9. The apparatus according to claim 8, wherein the type of the print medium includes plain paper and coated paper, in a case in which the type of the print medium is plain paper and printing with the first number of passes is performed, the control unit controls the ink ejection timing from the ejection port located at the end portion of the ejection port array based on the distance at the end portion of the ejection port array measured by the sensor, and in at least one of a case in which the type of the print medium is coated paper and a case in which printing with the second number of passes is performed, the control unit controls the ejection timing based on the distance at the center of the ejection port array measured by the other sensor.

10. The apparatus according to claim 6, wherein the receiving port is configured to receive and recover ink ejected from the printhead to the predetermined position in the predetermined direction, and the control unit controls the ejection timing at the position where the receiving port is provided.

11. The apparatus according to claim 10, wherein the receiving port is provided at each of a plurality of positions based on a size of the usable print medium, and the receiving port provided at each position is used as an ejected ink receiving port when preliminary ejection from the printhead is performed with respect to the print medium to be used.

12. The apparatus according to claim 1, wherein the apparatus prints an image in a unit area of the print medium on a first position of the platen by ejecting ink from the printhead while moving the carriage in a given direction, and after that, causes the conveyance unit to convey the print medium such that the unit area of the print medium is located at a second position different from the first position in a conveyance direction by the conveyance unit, and prints an image in an area at least partially different from the unit area by ejecting ink from the printhead while moving the carriage above the conveyed print medium in the given direction, in a case in which printing with the first number of passes is performed at the first position, the control unit controls the ink ejection timing from the printhead in accordance with the distance at the first position obtained by the obtaining unit, and in a case in which printing with the second number of passes is performed at the first position, the control unit controls the ink ejection timing from the printhead in accordance with the distance at the second position in the predetermined direction obtained by the obtaining unit.

13. The apparatus according to claim 1, wherein the control unit controls ejection such that a timing of ejecting ink to an area of the print medium where the distance is a second distance longer than a first distance is earlier than a timing of ejecting ink to an area of the print medium where the distance is the first distance.

14. The apparatus according to claim 1, wherein the number of passes of printing includes a first number of passes and a second number of passes, in a case in which printing with the first number of passes is performed, the control unit corrects, based on the distance at the position where the collection port is provided, which is measured by the measurement unit, the distance at an ejection port, facing a position different from the position where the collection port of the platen is provided, of an ejection port array formed by the plurality of ejection ports in a direction intersecting the predetermined direction, and controls to change, based on the corrected distance, the ink ejection timing from the ejection port of the ejection port array facing the different position, and in a case in which printing with the second number of passes is performed, the control unit controls the ejection timing based on the distance at the position where the collection port is provided, which is measured by the measurement unit.

15. The apparatus according to claim 1, further comprising:

a detection unit configured to detect a position of the carriage in the predetermined direction.

16. The apparatus according to claim 1, wherein a plurality of holes are formed in the platen to suck air and chuck the print medium.

17. An inkjet printing apparatus comprising:

a printhead in which a plurality of ejection ports that eject ink are formed so as to form an array;

a carriage mounted with the printhead and reciprocated in a predetermined direction;

a conveyance unit configured to convey a print medium on which an image is to be printed by ink droplets ejected from the printhead;

a platen extending in the predetermined direction, configured to support, at a printing position by the printhead, the print medium conveyed by the conveyance unit, and provided with a receiving port configured to receive the ink ejected from the printhead to a predetermined position facing the printhead;

an obtaining unit provided in the carriage and configured to obtain, at a plurality of positions in the predetermined direction, information regarding a distance from an ejection port surface of the printhead to the print medium on the platen at the plurality of positions in the predetermined direction; and a control unit, wherein a length of the receiving port in a direction intersecting the predetermined direction is greater than a length, in the intersecting direction, of an area where the ejection ports of the printhead are formed, and the control unit is configured to control, in printing in which an image is printed by, after printing an image on the print medium by ejecting ink from the printhead using the array of the ejection ports while moving the printhead in a forward direction by the carriage, conveying the print medium by the conveyance unit by an amount corresponding to a length of the array of the ejection ports in the intersecting direction, and ejecting ink from the printhead using the array of the ejection ports while moving the printhead above the conveyed print medium in a backward direction by the carriage, an ink ejection timing from the printhead based on the distance at an end portion of the array of the ejection ports in the intersecting direction, the distance being indicated by information obtained by the obtaining unit.

18. An inkjet printing apparatus comprising:

a printhead in which a plurality of ejection ports that eject ink are formed;

a carriage mounted with the printhead and reciprocated in a predetermined direction;

a conveyance unit configured to convey a print medium on which an image is to be printed by ink droplets ejected from the printhead;

a platen extending in the predetermined direction and configured to support, at a printing position by the printhead, the print medium conveyed by the conveyance unit, the platen being is provided with a receiving port configured to receive ink ejected from the printhead to a predetermined position in the predetermined direction, wherein the receiving port includes a collection port configured to collect the ink; and a measurement unit including a sensor configured to measure the distance at a position where the collection port is provided, wherein a timing of ejecting ink from the printhead to perform printing on the print medium located at the predetermined position of the platen in a case in which the number of passes of printing is one, which is the number of times of reciprocating the carriage to print the image in a unit area of the print medium, is different from a timing of ejecting ink from the printhead to perform printing on the print medium on the predetermined position of the platen in a case in which the number of passes of printing is more than one.

19. The apparatus according to claim 18, wherein the platen includes a portion where a distance from an ejection port surface of the printhead is a first distance, and a portion where the distance is a second distance longer than the first distance, and the predetermined position is a position where the distance between the platen and the ejection port surface is the second distance.

20. A control method of an inkjet printing apparatus comprising:

a printhead in which a plurality of ejection ports that eject ink are formed, a carriage mounted with the printhead and reciprocated in a predetermined direction, a conveyance unit configured to convey a print medium on which an image is to be printed by ink droplets ejected from the printhead, a platen extending in the predetermined direction and configured to support, at a printing position by the printhead, the print medium conveyed by the conveyance unit, the platen being provided with a receiving port configured to receive ink ejected from the printhead to a predetermined position in the predetermined direction, wherein the receiving port includes a collection port configured to collect the ink, an obtaining unit provided in the carriage and configured to obtain, at a plurality of positions in the predetermined direction, information regarding a distance from an ejection port surface of the printhead to the print medium on the platen at the plurality of positions in the predetermined direction, and a measurement unit including a sensor configured to measure the distance at a position where the collection port is provided, the method comprising:

controlling an ink ejection timing from the printhead in accordance with the information regarding the distance obtained by the obtaining unit and information corresponding to the number of passes of printing, which is the number of times of reciprocating the carriage to print the image in a unit area of the print medium.

* * * * *